United States Patent [19]

Carr

[11] 4,215,709

[45] Aug. 5, 1980

[54] HAIR SHAPING AND LIFTING SYSTEM

[76] Inventor: Uriah H. Carr, 8852 S. Michigan Ave., Chicago, Ill. 60619

[21] Appl. No.: 950,270

[22] Filed: Oct. 11, 1978

[51] Int. Cl.[2] ..... A45D 1/00

[52] U.S. Cl. ..... 132/9

[58] Field of Search ..... 132/46, 49, 9, 39; 2/208, 68, 171, 174, 201; 128/171, 76, 164

[56] References Cited

U.S. PATENT DOCUMENTS

| | | | |
|---|---|---|---|
| 2,125,622 | 8/1938 | Bleuel et al. | 132/36 |
| 2,818,074 | 12/1957 | Mach | 132/9 |
| 3,270,753 | 9/1966 | Cook et al. | 132/9 |
| 3,321,772 | 5/1967 | Arps et al. | 2/68 |
| 3,351,073 | 11/1967 | Gregg | 132/46 R |
| 3,586,009 | 6/1971 | Sirmons | 132/9 |

FOREIGN PATENT DOCUMENTS

| | | | |
|---|---|---|---|
| 706120 | 3/1931 | France | 132/46 |

*Primary Examiner*—G. E. McNeill

*Attorney, Agent, or Firm*—Hill, Van Santen, Steadman, Chiara & Simpson

[57] ABSTRACT

A hair shaping and lifting system is disclosed wherein a flexible hair supporting cap is receivable over the head of an individual whose hair is to be styled. The hair supporting cap has an outer deformable surface and a plurality of slots therein. The individual's hair is combed out through the slots so that portions of the hair lie on the deformable outer surface. The hair is moisturized and a molding cap is placed over the hair supporting cap so as to capture the hair between inner surface contours of the molding cap and the deformable outer surface of the hair supporting cap. The hair is then set by drying with the supporting cap and mold cap in place. Thereafter, the caps are removed and a hair style results in which the hair has been lifted and shaped in an aesthetically pleasing manner.

13 Claims, 5 Drawing Figures

HAIR SHAPING AND LIFTING SYSTEM

BACKGROUND OF THE INVENTION

This invention relates to hair styling systems.

In my prior U.S. Pat. No. 3,908,673 the use of a cap or hood for molding an individual's hair according to inner contour surfaces of the cap is disclosed for styling hair which naturally extends outwardly from the individual's head such as with stiff curly or kinky hair.

In my copending application, Case No. P78,197 titled "Hair Styling System" a hair styling system is described in which a mold cap is employed in combination with an outer hood which permits the creation of a vacuum so as to draw the hair upwardly from the hair towards the inner contoured surface of the mold cap.

SUMMARY OF THE INVENTION

It is an object of this invention to provide a hair shaping and lifting system in which a hair supporting and lifting cap is employed so as to support the individual's hair in spaced relationship from the head and then shaping or styling the hair at the spaced location.

It is a further object of this invention to provide a hair shaping and lifting system for use with an individual's hair which is straight rather than curly and which does not naturally stand out from the individual's head but rather lies closely adjacent the individual's head when not treated or styled.

It is another object of this invention to provide a supporting or lifting cap which supports portions of an individual's hair in spaced relationship from his head and wherein the supporting surface is deformable.

According to the invention, a hair supporting cap is provided which has a deformable outer surface and a plurality of apertures therein. The hair supporting cap is designed to conform to the shape of the head of the individual such that when the supporting cap is placed on the head, the individual's hair may be easily drawn through the plurality of apertures so that portions of the hair lie on the outer deformable surface of the supporting cap. A mold cap is provided having a contoured inner surface which corresponds to a desired hair style. The hair may either be pre-moisturized or moisturized after the supporting cap has been placed on the head of the individual. The mold cap is then placed over the hair supporting cap such that portions of the individual's hair are captured between the contoured inner surface of the mold cap and the deformable outer surface of the hair supporting cap. The hair is then dried with both caps in position so that the hair is shaped and styled in its raised position in accordance with the contoured inner surface of the mold cap. Thereafter, the mold cap and hair supporting cap are removed and the hair styling is completed.

The hair supporting cap preferably is formed of a flexible substrate with a sponge-like material joined to the substrate. Preferably the substrate is slotted and strips of the sponge-like material are aligned with the slots in the substrate.

DESCRIPTION OF THE PREFERRED EMBODIMENTS

Figure 1:
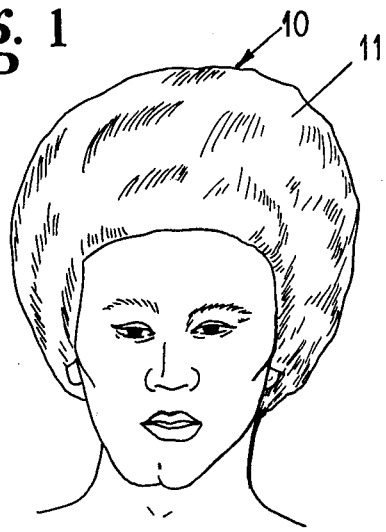
FIG. 1 is a perspective view of an individual whose hair has been styled in accordance with the invention.

With the hair shaping and lifting sytem according to the invention, a hair style such as shown at 11 in FIG. 1 on the head of an individual 10 may be created. Typically, the invention is most useful with an individual whose hair is straight and does not naturally stand out from the head. It is desired to create a shaped coiffure or hair style wherein the hair is spaced outwardly from the head so as to provide an aesthetic fullness of desired shaping.

Figure 2:
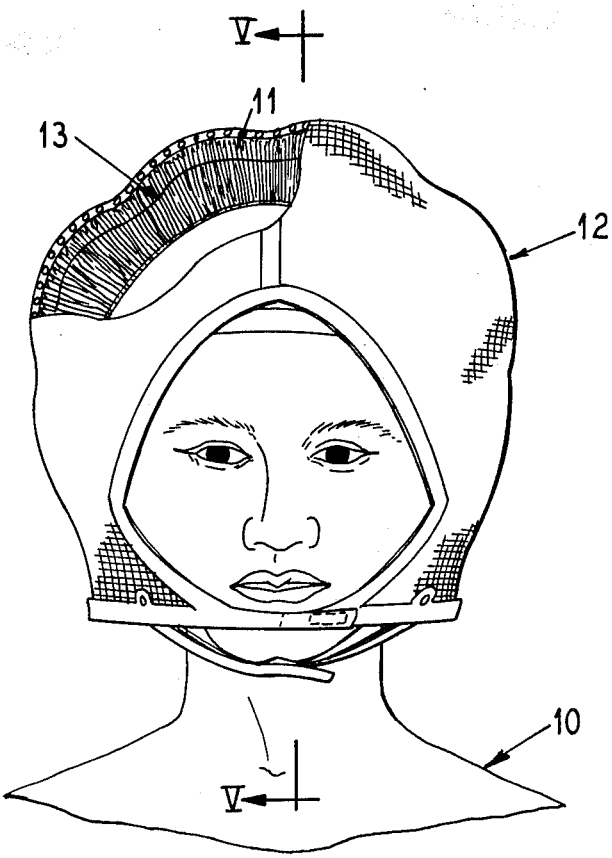
FIG. 2 is a front view of the hair shaping and lifting system of the invention with a partial cutaway so as to illustrate the use of an outer molding cap in combination with an inner hair supporting or lifting cap.

As illustrated in FIG. 2, a supporting or lifting cap 13 is received over the head of an individual 10. The individual's hair 11 is combed out through apertures in the cap 13 so that portions of the hair 11 lie on an outer deformable surface of the supporting cap 13. A mold cap 12 is positioned over the supporting or lifting cap 13 so as to capture the hair 11 of the individual between an inner contoured surface of the mold cap 12 and the outer deformable surface of the supporting cap 13.

Figure 3:
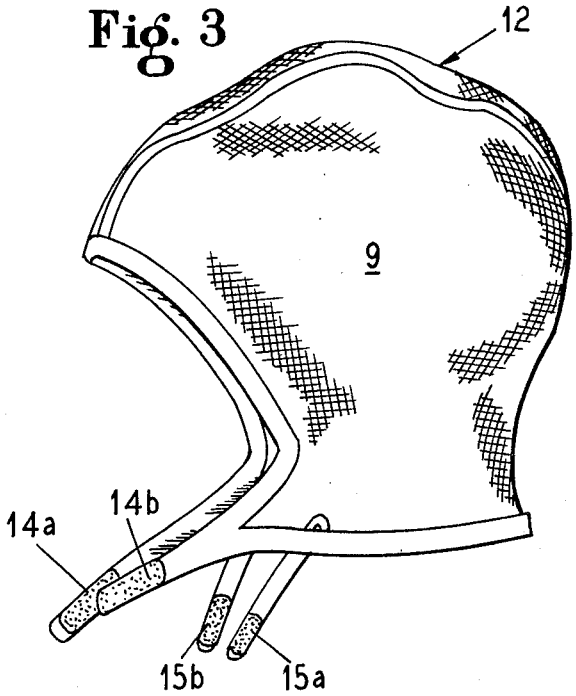
FIG. 3 is a perspective view of the mold cap illustrated in FIG. 2.

The mold cap 12 is illustrated in greater detal in FIG. 3. The preferred form of the mold cap 12 is described in greater detail in my copending application Case No. P78,197 titled "Hair Styling System", incorporated herein by reference. The mold cap 12 has a contoured molding surface 9 comprised of a fiberglass mesh coated with polyurethane for strengthening. The fiberglass mesh provides a large plurality of apertures in the mold surface 9 through which air may flow. The contours of the mold cap 12 correspond with the desired hair style shaping.

Chin support strips 14*a, b* and neck support strips 15*a, b* are also provided for securing fastening the mold cap 12 in position on the individual'head.

Figure 4:
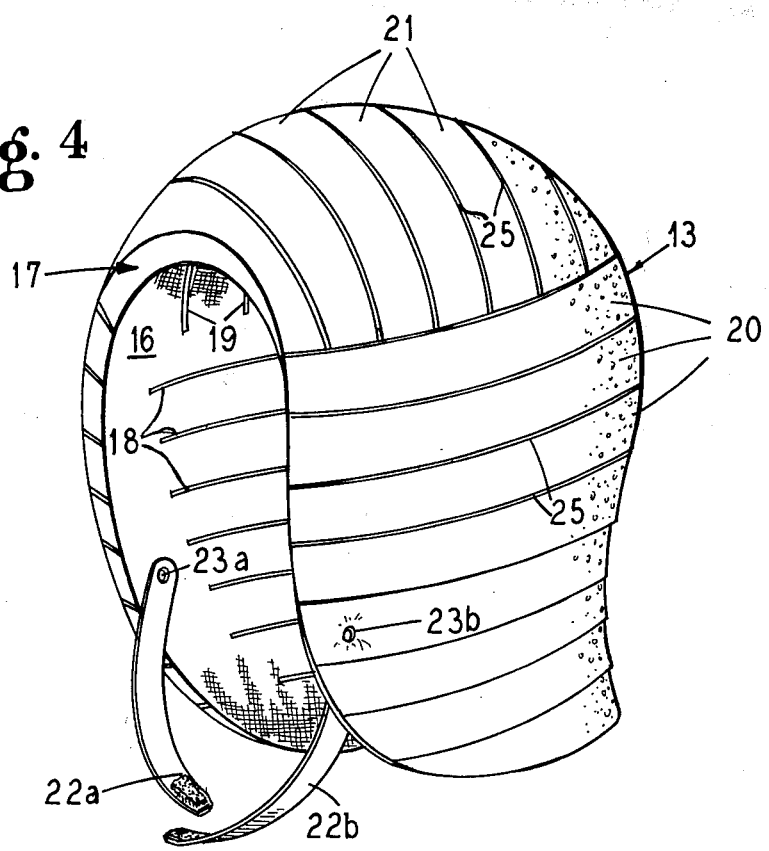
FIG. 4 is a perspective view of the hair lifting or supporting cap on the head of the individual illustrated in FIG. 2.

Referring now to FIG. 4, the construction of the supporting or lifting cap 13 will now be described in greater detail. Preferably the supporting cap 13 generally conforms to the head size of the individual. Strips 22*a, b* are provided which are connected to the supporting cap 13 by rivets 23*a, b*. These supporting strips permit the cap to be pulled snugly down on the head of the individual.

The supporting cap 13 is formed of a substrate 16 preferably comprising a fiberglass cloth which is plastic impregnated. A sponge-like material 17 is then attached to the substrate 16. The sponge-like material may be preferably formed of polyurethane foam. The fiberglass cloth substrate retains flexibility while retaining shape and resisting movement of the sponge-like material thereon. The polyurethane foam can be foamed in place or pre-foamed and applied. The foam utilized should resist degradation from hair treatment chemicals and heat.

The substrate 16 has a plurality of horizontal slots 18 therein which extend peripherally around the supporting cap 13. A plurality of slots 19 are also provided over a top of the cap 13. A plurality of horizontal strips 20 of the sponge-like material 17 are attached to the substrate 16 such that slits 25 between adjacent horizontal strips 20 are aligned with the horizontal slots 18 in the substrate 16. Similarly, top strips 21 of the sponge-like material 17 are provided over a top of the cap such that slits 25 between adjacent strips 21 ae aligned with the vertical slots 19. Importantly the slits 25 are tilted or angled with respect to the inner surface of the cap 13.

Figure 5:
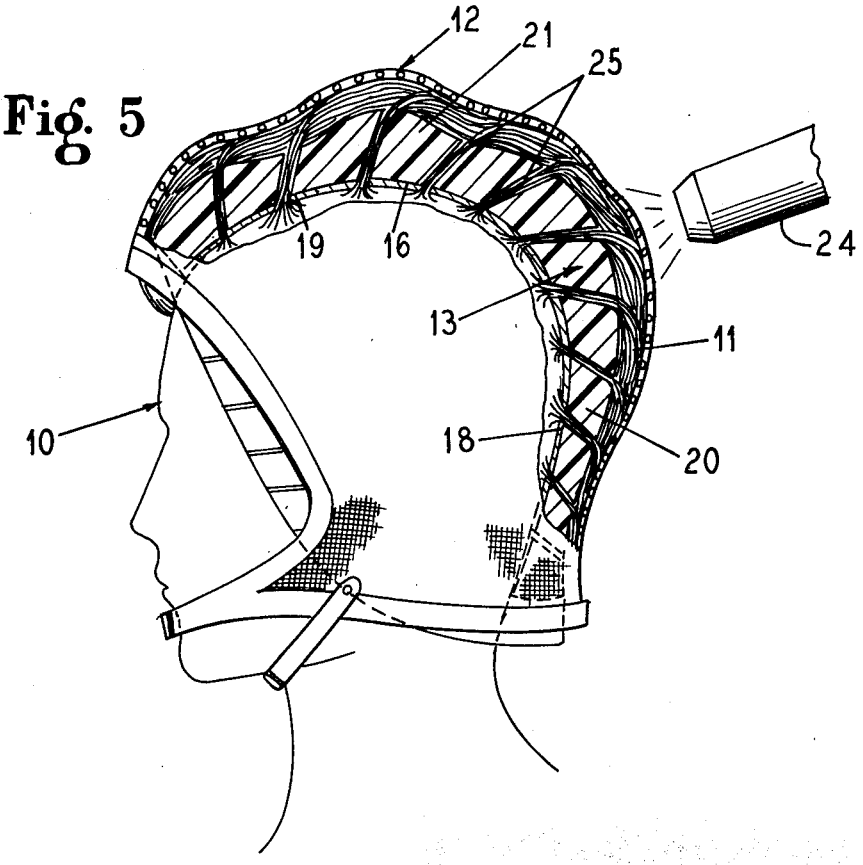
FIG. 5 is a side cross-sectional view taken along line V-V of FIG. 2.

Referring now to the cross-sectional view of FIG. 5, it can be seen how the hair 11 is positioned away from the hair so that it passes through the slots 18 or 19 and corresponding slits 25 so that portions of the hair lie over the outer deformable surface of the sponge-like material 17. It is also important to note that the slits formed between the sponge-like strips 20 and 21 are angled rearwardly or downwardly so that the hair is swept back away from the forehead of the individual and is arranged in a downwardly pattern at the rear of the head of the individual. FIG. 5 also illustrates how the contoured inner surface of the mold cap 12 captures the hair relative to the outer deformable surface of the supporting cap 13. The deformation of the supporting cap 13 in correspondence with the contoured curves of the mold cap 12 is also illustrated. A blow dryer 24 is provided for directing an airflow through the mesh-like mold cap 12 so as to dry the hair 11.

In accordance with a preferred method of the invention, the hair may be initially treated with a permanent solution. Thereafter, the hair may be neutralized and shampooed. After a thorough rinsing, the hair may be towel dried and a de-tangling solution applied. The hair is then combed towards the back of the head of the individual and the supporting or lifting cap 13 is fitted on the head of the individual. The hair is combed out through the slots and gaps of the cap 13. A moderate amount of wave set is then applied to the hair and the shaping or molding cap is placed over the hair and the supporting cap. The hair is then dried and thereafter the supporting cap and molding cap are removed. The hair may then be combed and a holding hair spray applied if desired.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A hair shaping and lifting system for styling the hair of an individual, comprising: a hair supporting cap means receivable over the head of an individual and having a given thickness for spacing the hair from the head so as to provide lifting, the cap means having aperture means through which the individual's hair is positioned so that portions of the hair lie on an outer surface of the cap means, said cap means being compressible such that the outer surface may be deformed; a molding cap means receivable over the hair supporting cap means and having an inner surface with contours corresponding to a shape of a desired hair style, the molding cap means being dimensioned so as to capture the portions of the individual's hair lying on the outer surface of the hair supporting cap means between said outer surface and the molding cap means inner surface, said outer surface being deformed in correspondence with the inner surface contours of the molding cap means causing corresponding compressed areas of the hair supporting cap means.

2. The system of claim 1 wherein the aperture means comprise slits extending along the outer surface of the supporting cap means.

3. The system of claim 1 wherein the hair supporting cap means comprises a flexible substrate with a sponge-like material on the substrate.

4. A hair shaping and lifting method for styling an individual's hair, comprising the steps of:

(a) placing a hair supporting cap having a deformable outer surface and a plurality of apertures onto a head of the individual;

(b) positioning the individual's hair through the apertures such that a portion of the hair rests on the deformable outer surface in spaced relationship with the individual's head so as to provide a lifting pattern for a desired hair style; and (c) placing a mold cap having a contoured inner surface corresponding to the desired hair style lifting pattern over the hair supporting cap so as to capture and shape the hair between the contoured inner surface and the deformable outer surface of the hair supporting cap.

5. The method of claim 4 wherein the hair supporting cap apertures comprise a plurality of slits and a comb is inserted through the slits so as to pull the individual's hair upwardly through the slits and back over the outer surface of the hair supporting cap.

6. The method of claim 4 wherein the hair is moisturized with a setting solution prior to placing the mold cap over the hair supporting cap and the hair is dried by blowing air through the mold cap after the mold cap is in position.

7. A hair styling cap for spacing portions of an individual's hair at a defined distance from the head, comprising: a flexible substrate formed so as to be receivable over the head of an individual whose hair is to be styled, a sponge-like compressible material attached to the substrate; and a plurality of aperture means through the substrate and sponge-like material for permitting the individual's hair to be positioned therethrough such that portions of the hair may lie on an outer surface formed by the sponge-like material when the cap is placed on the head of an individual, a thickness of the sponge-like material being sufficient to lift and space the hair from the head in a lifting pattern defined by selective compression of the sponge-like material.

8. The cap of claim 7 in which the aperture means comprise a plurality of slits.

9. The cap of claim 7 wherein the substrate has a plurality of slots therein and the sponge-like material is comprised of a plurality of strips arranged in side-by-side relationship so as to form slits between adjacent strips which are aligned with the slots in the substrate.

10. The cap of claim 9 wherein the slots in the substrate include a plurality of horizontal slots extending laterally around a periphery of the cap and a plurality of slots which are positioned over a top of the cap.

11. A hair shaping and lifting system for styling the hair of an individual, comprising: supporting means for spacing portions of the individual's hair from the head so as to provide a lifting pattern to the hair, said supporting means having a deformable outer surface upon which said portions of the hair can lie, said supporting means being shaped to be received over the head of an individual and shaping means cooperating with the supporting means for capturing portions of the individual's hair between an inner surface of the shaping means and the outer deformable surface of the supporting means, said shaping means having a contoured curved inner surface corresponding to the desired hair style lifting pattern.

12. The cap of claim 8 wherein at least some of the slits are angled to the inner surface of the cap at other than a right angle.

13. The cap of claim 4 wherein the contoured inner surface of the mold cap compresses the hair supporting cap so that the supporting cap has varying thicknesses to provide various spacings of the hair from the head.

* * * * *